US009481509B2

(12) United States Patent
Vidal

(10) Patent No.: US 9,481,509 B2
(45) Date of Patent: Nov. 1, 2016

(54) DEVICE AND METHOD FOR HANDLING CONTAINERS AND CONTAINER COMPRISING SAID DEVICE

(75) Inventor: Oscar Fillol Vidal, Barcelona (ES)

(73) Assignee: CYXER LIMITED, Floriana Frn (MT)

( * ) Notice: Subject to any disclaimer, the term of this patent is extended or adjusted under 35 U.S.C. 154(b) by 1180 days.

(21) Appl. No.: 12/522,404

(22) PCT Filed: Jan. 11, 2008

(86) PCT No.: PCT/ES2008/000009

§ 371 (c)(1),
(2), (4) Date: Jul. 15, 2011

(87) PCT Pub. No.: WO2008/084130

PCT Pub. Date: Jul. 17, 2008

(65) Prior Publication Data

US 2011/0260479 A1 Oct. 27, 2011

(30) Foreign Application Priority Data

Jan. 11, 2007 (ES) ..... 200700113
May 16, 2007 (ES) ..... 200701012 U
May 16, 2007 (ES) ..... 200701013 U

(51) Int. Cl.

| | |
|---|---|
| ***B66C 1/06*** | (2006.01) |
| ***B65D 88/16*** | (2006.01) |
| ***B66C 1/04*** | (2006.01) |
| ***B66C 1/22*** | (2006.01) |

(52) U.S. Cl.

CPC ..... *B65D 88/1681* (2013.01); *B65D 88/1668* (2013.01); *B65D 88/1687* (2013.01); *B66C 1/04* (2013.01); *B66C 1/06* (2013.01); *B66C 1/226* (2013.01); *Y10T 16/44* (2015.01)

(58) Field of Classification Search

CPC ..... B66C 1/06; B66F 9/182
USPC ..... 294/68.1, 68.3; 414/606
See application file for complete search history.

(56) References Cited

U.S. PATENT DOCUMENTS 2,433,938 A * 1/1948 Varner ..... B66C 1/06 294/82.1
3,493,259 A * 2/1970 Morgan ..... 294/74
3,532,376 A * 10/1970 Munck ..... 294/74
4,792,171 A 12/1988 Lamy
5,269,579 A 12/1993 DeCrane (Continued)

FOREIGN PATENT DOCUMENTS

EP 0 259 230 3/1988
EP 1 045 802 10/2000

(Continued)

OTHER PUBLICATIONS

Office Action dated Aug. 31, 2012 for Application No. JP 2009-545205 with English translation.

(Continued)

*Primary Examiner* — James Keenan
(74) *Attorney, Agent, or Firm* — Ladas & Parry LLP

(57) ABSTRACT

A device comprising a hook and magnet. The hook is configured to move between a folded position, such that the space below the magnet is free, and a deployed position, such that the hook is below the magnet. The magnet is activated to attract a ferromagnetic piece connected to a support handle of a container.

10 Claims, 4 Drawing Sheets

(56) References Cited

U.S. PATENT DOCUMENTS

| | | | | |
|---|---|---|---|---|
| 5,299,845 | A * | 4/1994 | Gabriel | 294/2 |
| 6,390,675 | B1 | 5/2002 | Jardine | |
| 6,412,837 | B2 * | 7/2002 | Futa | 294/3 |
| 2001/0000464 | A1 | 4/2001 | Beale | |
| 2004/0032140 | A1 * | 2/2004 | Solstad | B66C 1/06 294/82.15 |
| 2007/0222243 | A1 * | 9/2007 | Molaug | 294/82.3 |

FOREIGN PATENT DOCUMENTS

| | | | |
|---|---|---|---|
| FR | 2 608 138 | | 6/1988 |
| JP | 7-206367 | A | 8/1995 |
| JP | 11-255289 | A | 9/1999 |
| JP | 11-349271 | A | 12/1999 |
| JP | 2002-37385 | A | 2/2002 |
| JP | 2002-225977 | | 8/2002 |
| JP | 2004-149160 | A | 5/2004 |
| JP | 2006-55676 | A | 3/2006 |
| JP | 2006-240631 | A | 9/2006 |
| JP | 2007-514625 | A | 6/2007 |
| WO | 97/03911 | | 2/1997 |

OTHER PUBLICATIONS

Patent Abstracts of Japan English abstract of JP 07-206367 A.

* cited by examiner

DEVICE AND METHOD FOR HANDLING CONTAINERS AND CONTAINER COMPRISING SAID DEVICE

OBJECT OF THE INVENTION

A first aspect of the present invention relates to a device for handling containers, a second aspect relates to a container comprising said device and a third aspect relates to a method for handling said containers, said three aspects having application in the goods transport industry, and preferably in the field of construction in handling and transporting bulk materials or debris.

BACKGROUND OF THE INVENTION

Different types of containers are known today that are intended for storing and transporting large volumes of materials which are generally bulk materials or debris, for which it is in turn necessary to handle the actual container once it is loaded to either remove the materials contained therein or to transport them to the location in which they are going to be used, which is a very slow and complex operation due to the large weight and volume of these containers, making them difficult to handle.

For example, there is a type of container comprising a rigid body, normal of metal, the sizes of which vary depending on their application and the volume of material to be contained, being intended for containing debris, to which end they are temporarily placed on a public road close to the point of removal of the debris.

To handle these containers a goods transport vehicle is required which comprises lifting means for fixing them to a sling which normally comprises four chains the ends of which are fixed to anchoring points on the sides of the container, all during a slow operation which requires, in addition to the mentioned lifting means, the direct participation of an operator for fixing the ends of the chains at fixing points of the container.

In addition, there is another type of container commonly known as flexible containers or sacks intended for containing bulk or dust materials, commonly used in the field of construction as well as in the transport and removal of debris in minor construction jobs given their size, such as for example in the refurbishing of shops and homes.

This type of container normally comprises a lower panel and four side panels defining an inner space intended for containing, for example, a bulk material. These containers are known by the abbreviation FIBC (Flexible Intermediate Bulk Containers), and are normally made of woven raffia polyethylene.

This type of container has several configurations which allow for different applications, especially in relation to the support means which allow the lifting thereof in container loading and unloading operations.

In relation to said support means, one of the most widely used containers comprises a handle in each of the upper corners formed by the side panels, which allows the gripping thereof by a crane hook, or any other mechanism or substructure coupled to said four handles when the container is lifted.

There are other variants in which the container comprises ropes or chains arranged between each of the handles placed in each corner. In some cases, these ropes or chains are arranged parallel two by two, such that the container comprises two longitudinal handles and two transverse handles, which are normally perpendicular to the longitudinal handles in the event that the plan of the container is rectangular and therefore has four side panels.

Another type of container has a single rope which is arranged inside all the corner handles, such that it allows supporting while at the same time causing, precisely by the effect of said support, the automatic closing of the container when the latter is in the loaded situation.

There is a feature that is common to the containers discussed up to this point, which is a direct consequence of the considerable loads that these containers are able to withstand when they are in the loaded situation, reaching an order of magnitude of a thousand kilos. Said common feature is that handling these containers requires the use of lifting means such as cranes or forklift trucks.

The main drawback of all these containers is also that the linkage to the lifting means must be done manually by an operator, normally at several points of the container as in the case of four points each being located in an upper corner of the container. Said manual linkage must be done both in the hooking operations for hooking and in the operations for unhooking the container, with the subsequent delay caused in the handling process and its negative repercussion on transport costs, resulting in a high risk for the safety of the operator.

There are different manners of linking the lifting means with the container. For example, the containers comprising a handle in each upper corner for the linkage thereof with a hook require manually hooking the hook in each of the four handles of the container. To unhook the container, it is also necessary to act manually to unlink the hooks from the handles of the container, with the subsequent loss of time this involves.

There are also slings comprising chains with four branches, or belts, which allow the operator to hook the ring of the sling to the crane hook and then each hook in a handle of the container.

In addition to the drawback of requiring a manual hooking, another drawback of this type of container is that the lifting means are not always available when the container is to be handled.

An example of a device used as support means for this type of container is described in U.S. Pat. No. 5,269,579, relating to a device for lifting bulk bags, configured as a structure comprising four branches and an element which allows being hooked by a crane hook. Each of the ends of the branches has a hinged element that can be vertically positioned between a downward position and an upward position, intended for being housed in handles the container has in its corners, such that it allows the lifting thereof.

As in the previous case, this device has the drawback of being extremely complex and expensive, and it further requires carrying the device at all times. In addition, the device offers very little safety given the high possibility of the failure of the hinged element, which must be placed manually by an operator.

In addition, European patent application no. EP 0259230 describes a device for handling large capacity bags intended for containing bulk materials comprising a lower panel and four side panels, all of which are flexible, having a handle in each of the upper corners, allowing the housing of a quadrangular rigid structure which can allow the fixing thereof to lifting means, such as crane hooks for example.

However this is not very reliable in situations in which the rigid structure or any of the handles break, being extremely unstable and requiring several points of support of the rigid structure, for the purpose of preventing the container from overturning, especially in the loaded situation. This device is not versatile and is complicated to install, requiring the manual action of an operator and the need for carrying said rigid structure at all times, with the subsequent risk of forgetting said structure and the impossibility of handling the container.

Likewise, to handle and transport this type of container in short distances, even for the side loading in goods transport vehicles, forklift trucks are also used to which end the manual coupling of the fork of the forklift truck into the handles of the container, in combination with handling the forklift truck itself, is required; therefore at least two operators are required, with the subsequent risk for the safety of the operator responsible for handling the handles and the increase in the container transport costs.

An example of this type of handling means is described in European patent no. EP 1045802, which relates to a flexible bag intended for storing and allowing the transport of bulk materials, to which end said bag comprises a lower panel and side panels, likewise having two parallel resilient tubular elements fixed to the upper part of the side panels, serving as a guide for the fork of a forklift truck, which thus allows handling the bag.

The main drawback of this type of bag is that it can only be handled by means of this type of lifting means, having to adapt a crane or any other element to the parallel configuration of a fork to allow performing bag loading and unloading operations.

Based on the foregoing, the linkage of a container with means configured to allow its handling, including its lifting, transport as well as container loading and unloading operations in a goods transport vehicle, currently require direct manual intervention in the actual container by an operator, with the subsequent loss of time, and therefore increase in transport cost, as well as a high risk of an accident occurring for the operator.

DESCRIPTION OF THE INVENTION

A first aspect of the present invention relates to a device for handling containers, preferably flexible containers, comprising gripping or holding elements such as handles for hooking the support means, and allowing hooking that is carried out quickly and easily, with the subsequent savings of time and cost reduction this involves, which allows minimizing the risk of accidents for the operator.

The device is furthermore extremely versatile given that it allows being used for a wide variety of containers, for example in the case of flexible containers it allows being used with any container comprising gripping or holding elements, such as handles, belts or straps, intended for hooking the support or lifting devices or means, contemplating all the variants existing today in relation to the arrangement of said handles in flexible containers.

The device for handling containers proposed by the invention allows being incorporated in any existing type of support means, such as derrick cranes, mobile cranes or small cranes incorporated in some goods transport vehicles in the part corresponding to the trailer for loading and unloading operations. In this last case, the invention allows using the controls of the lifting means incorporated in the vehicle for controlling, handling and activating the device proposed by the invention.

According to the invention, the device for handling containers comprises at least one hook which is preferably placed at an end of the lifting means, which can consist of a crane or of lifting means comprised in some goods transport vehicles built into the vehicle itself. The hook is better controlled and handled by means of arranging said hook at the end of the lifting means.

The device of the invention can be used with quadruple branch chain slings, hooking the hook in the ring of the sling, each hook of the sling being operatively hooked to the handles of the container. The device likewise allows being used with cloth slings.

The containers to be handled, which are preferably flexible, commonly comprise at least one support handle which allows stable lifting, either at a single point of the container or at several points, even when the container is in a loaded situation. It is contemplated that the container can have any configuration provided that it comprises at least one support handle, which is normally fixed to two side panels or opposite corners of said container.

The hook allows being hinged around a hinge pin, preferably by means of automated and remote control, although it is contemplated that the hooking is carried out manually, and in any case the unhooking is carried out automatically, for example by means of remote control by radio frequency.

The hook therefore allows hinging between a folded position, in which a space below the hinge pin is free, and a deployed position, in which the hook is placed below the hinge pin.

When the hook is in the deployed position, it allows picking up, bearing or supporting the entire container by means of supporting at least one support handle.

The advantages of this device are clear, in any case allowing automatic unhooking, which allows saving time and minimizing the risk of accidents for the operator, with the subsequent savings and high versatility.

The possibility that the device of the invention allows the operator to hook the lifting means or crane from controls thereof is contemplated, thereby being able to control the hinging of the hook, with the subsequent savings in time, resources and risk reduction.

The device of the invention further allows being used with a wide variety of containers existing today, and preferably with flexible type containers, as well as handling two containers at the same time by placing the support handles of each container close to one another, increasing productivity by reducing lifting and loading times. The device of the invention can also be applied to any type of load and for the fast coupling of other tools or accessories, such as a forklift for example.

The possibility that the device for handling containers proposed by the invention comprises at least one hook and electromagnetic means, which preferably consist of an electromagnet, both placed in the lifting means, is additionally contemplated. The replacement of the electromagnetic means with a permanent magnet, which would perform the function of the electromagnet being permanently activated, is completely equivalent and likewise contemplated in the invention.

The electromagnetic means are configured to generate a magnetic field, when they are activated, which allows them to attract, by the effect of the electromagnetic force of said magnetic field, a ferromagnetic element, although the invention can comprise a plurality of ferromagnetic elements connected to a support handle of a container, which can be a flexible container for example.

The ferromagnetic elements can consist of any small sized part made of ferromagnetic material, such as a for example a hoop, a plate, a rivet, a clamp, a cable, a strip, a wire, a filament, a pipe, a disc or a clip, any type of connection with at least one support handle being contemplated, such as a mechanical connection for example, or housed in a cavity or pocket, sewn, clamped or adhered.

It is contemplated that the container can have any configuration provided that it comprises at least one support handle which allows stable lifting at a single point of the container, even when the container is in a loaded situation, said support handle normally being fixed to two side panels or opposite corners of the container.

The hook allows being hinged around a hinge pin, preferably by means of automated and remote control, between a folded position, in which a space below the electromagnetic means is free, and a deployed position, in which the hook is placed below the electromagnetic means. The electromagnetic means are preferably located below the hinge pin of the hook, although the possibility that the hook and the electromagnetic means are arranged separately, for example in contiguous segments of the telescopic arm of a crane, is contemplated.

This device allows automatic hooking without any loss of time or risk of accidents for the operator, with the subsequent savings, and high versatility.

The device of the invention allows the operator to hook the lifting means or crane from controls thereof, with which controls the activation of the electromagnetic means and the hinging position of the hook can be controlled, with the subsequent savings in time, resources and reduction of risks.

The possibility that the ferromagnetic element is connected to the container, preferably to an upper edge of a side panel, by means of a preferably resilient fastening element, so that the ferromagnetic element is maintained in a position accessible for the electromagnetic means and is not outside its reach, additionally reinforcing safety against a possible loss of said ferromagnetic element, is likewise contemplated.

A second aspect of the invention relates to a container comprising a device for the handling thereof such as that described above.

The container of the invention allows quick hooking that is carried out without a loss of time, resulting in an extremely versatile container as it allows being used in connection with any type of lifting means, such as universal cranes in goods transport vehicles for example.

The container of the invention further allows fully providing a space corresponding to a filling opening or access of the container, which facilitates loading and unloading operations.

The container proposed by the invention is preferably flexible and comprises at least one support handle configured to allow stable lifting at a single point of the container. Said point of lifting is preferably the point at which a hook is anchored, and coincides with the center of gravity of a plan projection of the container, which allows vertical lifting of the container.

The flexible container of the invention comprises a plurality of side panels, preferably four side panels, and a lower panel, which defines a body of the container.

The possibility that the container comprises at least two longitudinal handles, parallel two by two, which are fixed to an upper part of two opposite side panels, at least one support handle being linked preferably transversely to two longitudinal handles, allowing the relative movement of the support handle along the longitudinal handles, is additionally contemplated.

In any case, the support handle can consist of a sewn rope or belt, being able to have a closed hoop-like configuration, or an open configuration, having its ends sewn, which can likewise be sewn in its central part. The longitudinal handles traverse the support handle, which can move on these said longitudinal handles, freeing up the upper opening of access to the container for the content loading and unloading operations.

In the case of double filling stations, leaving the support handles of two contiguous containers close to one another allows double hooking and lifting by means of a single hook.

In addition, the longitudinal handles preferably have certain rigidity with which they are maintained at all times in a hoisted or raised position, which allows quick handling of the container by means of coupling a fork of a forklift truck below said longitudinal handles, without the need for handling or a manual hooking by an operator, allowing being hung in a filling station only by two handles and not four.

The possibility that the container comprises an upper lid, connected to an upper edge of a side panel, said upper lid configured to cover the access to the container and to protect its content, is contemplated.

The possibility that the upper lid comprises a handle, preferably placed on the side opposite the side of the connection of the upper lid with the side panel of the container, said handle being configured to allow comfortable handling of the upper lid, is additionally contemplated. By means of this upper lid, once the container is filled and the content requires being protected from the elements, cold, wind or rain, the upper lid is placed without the need for any additional handling. This therefore prevents the particles of the contained material from dispersing into the atmosphere while the container is transported, with the subsequent environmental contamination problems and loss of the load or content of the container.

The possibility that the upper lid comprises at least one transparent surface, like a window, which can occupy the entire surface of the upper lid, which allows seeing the inside of the container, as well as its content, is additionally contemplated. Said transparent surface allows visually inspecting or identifying the content of the container immediately, at the same time that the upper lid is closed, whereby the content is kept protected.

For the handling of the container of the invention, placing the lifting means, which can consist of a crane, on at least one container is contemplated, said lifting means comprising a hingable hook for its hooking in the support handle.

The double handling of containers is carried out in the same manner, as in the case of double filling stations, in which leaving the support handles of two contiguous containers close to one another allows a double hooking by the lifting means.

Likewise, the container allows its filling in a loading station by hanging two longitudinal handles and the handle of the upper lid of an empty container on parallel filling supports below a filling area for filling the container, which can consist of a filling hopper. Each loading station normally comprises a vertical unloading hopper assembled on a raised structure below which there is a system of fixed supports which allow positioning the container in a suspended manner. The container is gradually opened during the backward movement of the operator who hangs the container. The container is then filled from the filling hopper. A fork of a forklift truck is then placed below the longitudinal handles and the handle, carrying out a forward movement and passing the fork through the inside of the longitudinal handles and the handle of the upper lid. The fork is then lifted and the container is removed from the filling area, moving backwards to remove the container from the filling station. Finally, the fork is lowered until supporting the container on the ground, removing the fork whereby pulling on the handle and passing the upper lid below the longitudinal handles, placing the upper lid in the closed position covering the access to the inside of the container, not being able to be accidentally lifted by the action of the wind, for example.

It is likewise contemplated that at least one support handle is connected with at least one previously described ferromagnetic element which is configured to be attracted by the electromagnetic means of the device for handling containers when said electromagnetic means are activated by the action of the generated magnetic field.

The container of the invention can have a corner handle at each free upper end of the connection between side panels, said corner handles allowing housing at least one support handle for their gripping with the hook. Nevertheless, the possibility that the container of the invention has any other configuration, provided that it comprises at least one support handle such as that described above, is contemplated.

In addition, instead of the corner handles, the possibility that the container comprises at least two longitudinal handles, parallel two by two, which are fixed to the upper part of two opposite side panels, at least one support handle being connected to two longitudinal handles, is contemplated.

Finally, a third aspect of the invention relates to a method for handling containers which is comfortable, quick and extremely versatile, comprising the following steps:

Placing, preferably by an operator, the lifting means which can consist of a crane on at least one container. The lifting means comprise at least one hook hingable around a hinge pin, and electromagnetic means which allow generating a magnetic field when they are activated.

Said container comprises at least one support handle which is connected with at least one ferromagnetic element, the hook being in a folded position and the electromagnetic means deactivated.

The electromagnetic means are then activated, attracting the ferromagnetic element and therefore a support handle.

The hook is then hinged, preferably in an automated manner, to a deployed position in which said hook is below the electromagnetic means.

The electromagnetic means are then deactivated, the support handle being supported by the hook, after which the lifting means are handled to position the container in a destination location, for example a trailer of a goods transport vehicle. It is obvious than when the container is in a loaded situation, when it is lifted, the actual weight of the container makes the support handle be supported only by the hook.

Finally, the hook is hinged to a folded position to release the support handle and therefore the entire container.

The double handling of containers is carried out in the same manner. In the case of double filling stations, leaving the support handles of two contiguous containers close to one another allows a double hooking by the crane.

A method is optionally contemplated which is carried out prior to the previously described steps, forming a filling step comprising the following steps:

Two longitudinal handles and a handle of an upper lid of an empty container are first hung in parallel filling supports below a filling area for filling the container, which can consist of a filling hopper.

Each loading station normally comprises a vertical unloading hopper assembled on a raised structure below which there is a system of fixed supports which allow positioning the container in a suspended manner. The container is gradually opened during the backward movement of the operator who hangs the container.

The container is then filled with a content, normally a bulk material which is unloaded from the filling hopper to the inside of the container.

A fork of a forklift truck is then placed below the longitudinal handles and the handle, carrying out a forward movement and passing the fork through the inside of the longitudinal handles and the handle of the upper lid.

The fork is then lifted and the container is removed from the filling area, moving backwards to remove the container from the filling station.

The fork is then lowered until supporting the container on the ground, removing the fork whereby pulling on the handle and passing the upper lid below the longitudinal handles, placing the upper lid in the closed position covering the access to the inside of the container, not being able to be accidentally lifted by the action of the wind, for example.

Upon lowering the fork and moving backwards, the handle of the upper lid is pulled on at the same time, detaching the handle with a final downward movement. The container is thus ready to be then hooked and transported by means of the previously described method.

DESCRIPTION OF THE DRAWINGS

To complement the description which is being made and with the aim of aiding to better understand the features of the invention according to a preferred practical embodiment thereof, a set of drawings is attached as an integral part of said description, in which the following has been shown with an illustrative and non-limiting character.

PREFERRED EMBODIMENT OF THE INVENTION

In view of the indicated figures, it can be observed how in one of the possible embodiments of the first aspect of the invention, the device for handling containers comprises at least one hook (1) and electromagnetic means (3), both placed in lifting means.

Figure 4:
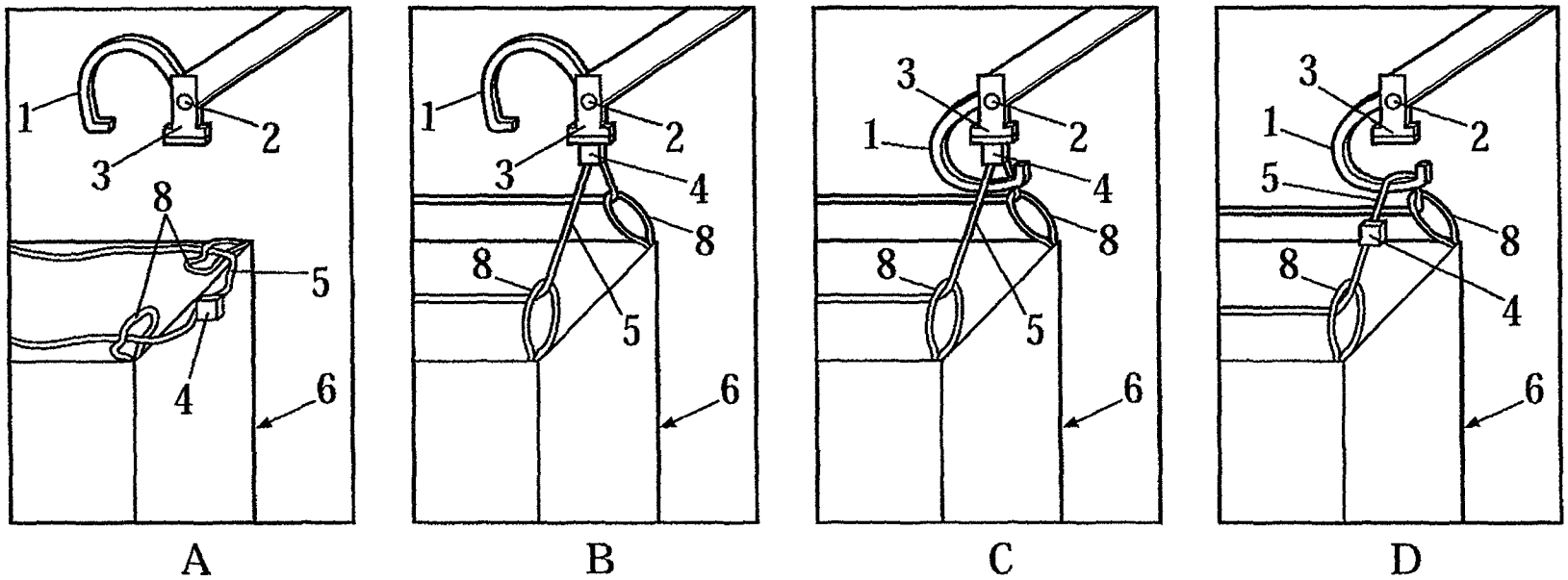
FIG. 4 shows a schematic flow diagram in which the steps comprised by the method for handling containers proposed by the invention can be seen.

The electromagnetic means (3) are configured to generate a magnetic field, when they are activated, and to attract, by the effect of the electromagnetic force, at least one ferromagnetic element (4) which is connected to a support handle (5) of a container (6), as can be seen in FIG. 4.

The container (6) comprises at least one support handle (5) configured to allow stable lifting, at a single point, of the container (6).

The hook (1) is configured to hinge around a hinge pin (2), preferably by means of automated and remote control, between a folded position, in which a space below the electromagnetic means (3) is free, and a deployed position, in which the hook (1) is placed below the electromagnetic means (3).

When the hook (1) is in the deployed position, it is configured to pick up and support the container (6), by means of supporting the support handle (5), when the electromagnetic means (3) release it upon being deactivated, preferably in a manner controlled by an operator.

Figure 1:
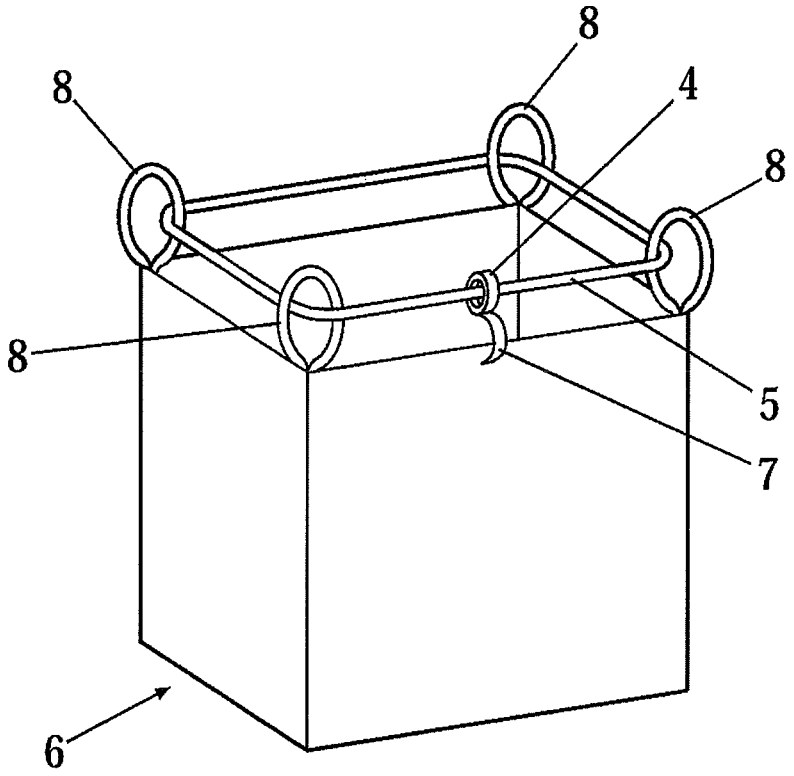
FIG. 1 shows a schematic perspective view of a container comprising a device for the handling thereof according to the invention.

As has been shown in FIG. 1, the ferromagnetic element (4) is connected to the container (6), preferably at an upper edge of a side panel, by means of a preferably resilient fastening element (7), so that the ferromagnetic element (4) is maintained in a position accessible for the electromagnetic means (3) and is not outside its reach, additionally reinforcing the safety against a possible loss of said ferromagnetic element (4).

A second aspect of the invention relates to a container comprising a device for the handling thereof, such as that described above.

The container proposed by the invention comprises at least one support handle (5) configured to allow stable lifting at a single point of the container (6).

At least one support handle (5) is connected with at least one ferromagnetic element (4), which is configured to be attracted by the electromagnetic means (3), when they are activated, by the action of the generated magnetic field.

The container (6) comprises four side panels (15) and a lower panel (16), which forms and defines a body of the container.

As can be seen in FIGS. 1 and 4, the container (6) comprises a corner handle (8) at each free upper end of the connection between side panels, said corner handles (8) being configured to house at least one support handle (5) for their gripping with the hook (1).

Figure 2:
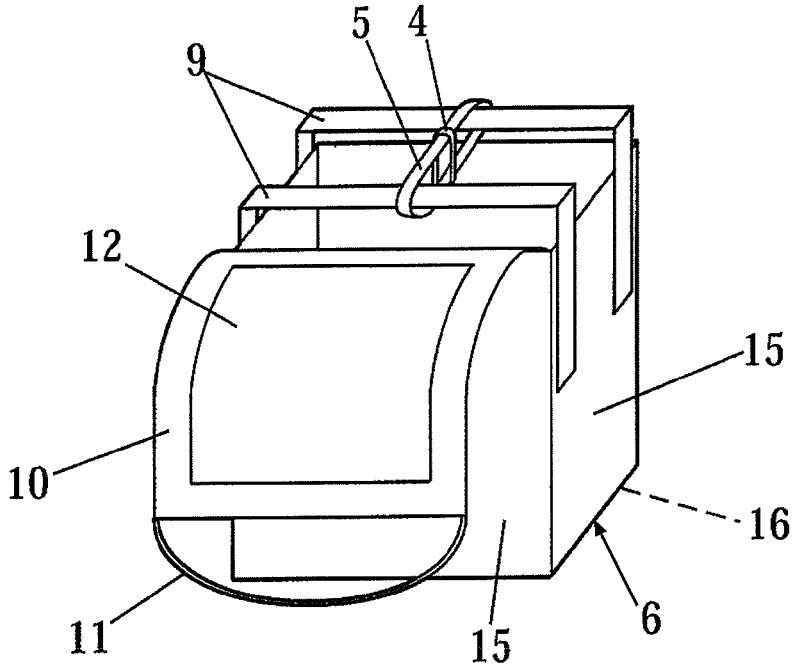
FIG. 2 shows a schematic perspective view of a variant of the container shown in the previous figure.
Figure 3:
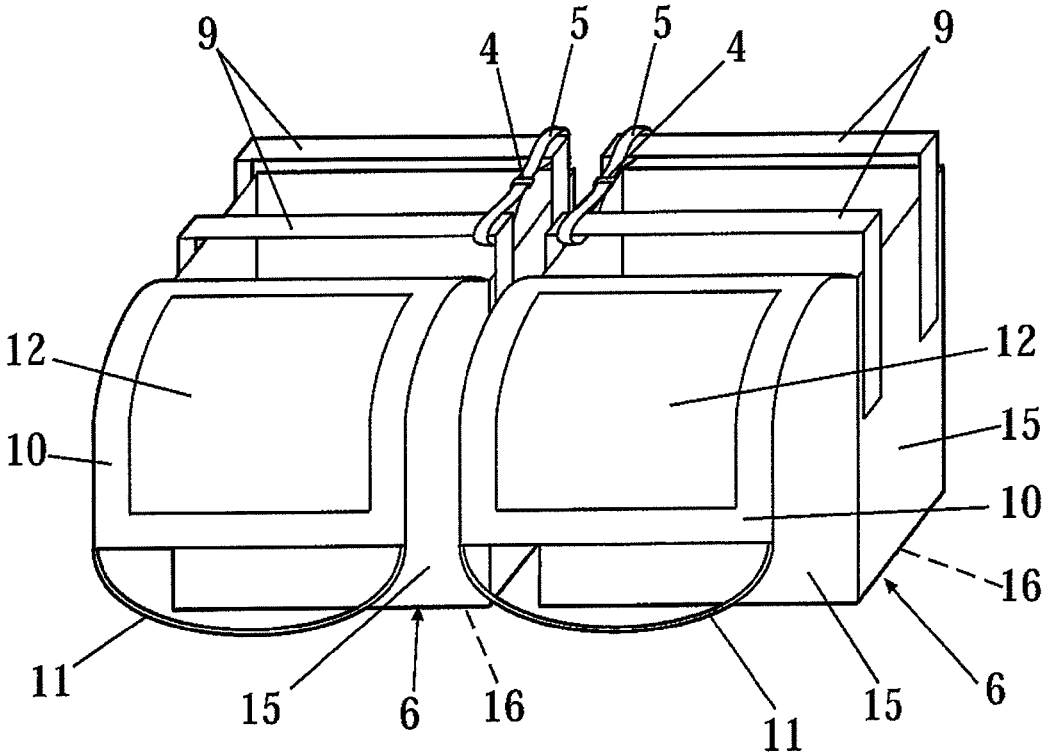
FIG. 3 shows a view like that of the previous figure, in which two containers prepared for the joint handling thereof can be seen.
Figure 5:
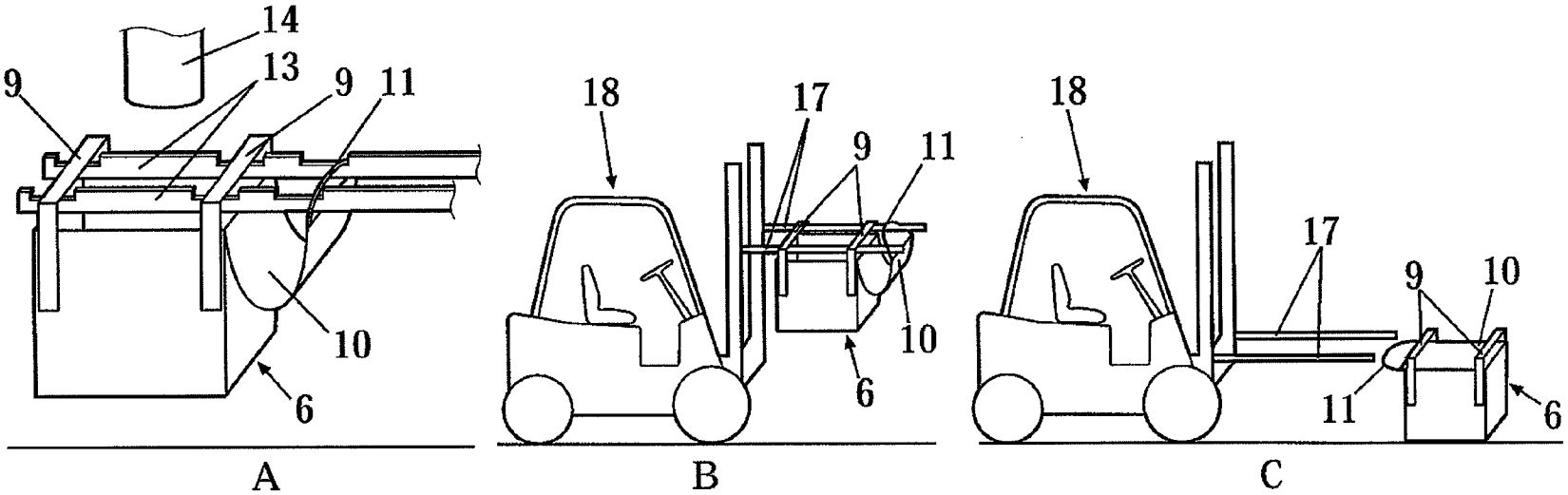
FIG. 5 shows a schematic flow diagram in which a filling method prior to the method for handling shown in FIG. 4 can be seen.

According to an embodiment variant of the container of the invention, shown in FIGS. 2, 3 and 5, the container (6) comprises at least two longitudinal handles (9), parallel two by two, which are fixed to the upper part of two opposite side panels, at least one support handle (5) being connected to two longitudinal handles (9).

The longitudinal handles (9) preferably traverse the support handle (5), which is configured to move on these said longitudinal handles (9), freeing up the upper opening of access to the container for loading and unloading operations.

As has been shown in FIG. 3, in the case of double filling stations, leaving the support handles (5) of two contiguous containers (6) close to one another, two containers (6) can be hooked by the hook (1).

The container comprises an upper lid (10), connected to an upper edge of a side panel, configured to cover the access to the container and to protect its content, in turn comprising a handle (11), preferably placed in the side opposite that of connection with the side panel of the container (6), said handle (11) being configured to allow handling the upper lid (10).

As can be seen in FIGS. 2 and 3, the upper lid (10) comprises at least one transparent surface (12) configured to allow seeing the inside of the container (6), as well as its content.

Finally, a third aspect of the invention relates to a method for handling containers, comprising the following steps:

As has been shown in view A of FIG. 4, the method comprises placing the lifting means on at least one container (6). Said lifting means comprise at least one hook (1) hingable around a hinge pin (2), and electromagnetic means (3) which allow generating a magnetic field when they are activated.

Said container (6) comprises at least one support handle (5) which is connected with at least one ferromagnetic element (4), the hook (1) being in the folded position and the electromagnetic means (3) deactivated.

Then, as shown in view B of FIG. 4, the electromagnetic means (3) are activated, attracting the ferromagnetic element (4), and therefore a support handle (5).

The hook (1) is then hinged to a deployed position in which said hook (1) is below the electromagnetic means (3), as can be seen in view C of FIG. 4.

Then, as has been shown in view D of FIG. 4, the electromagnetic means (3) are deactivated, the support handle (5) being supported by the hook (1), after which the lifting means are handled to position the container (6) in a destination location, for example a trailer of a goods transport vehicle.

Finally, the hook (1) is hinged to a folded position to release the support handle (5) and therefore the entire container (6).

In the case of double filling stations, leaving the support handles (5) of two contiguous containers (6) close to one another allows a double hooking by the crane, as shown in FIG. 3, allowing a double handling of containers, which is carried out in the same manner.

The possibility that the method comprises an optional filling step which is carried out prior to the previously described steps is contemplated, comprising the following steps, as has been shown in FIG. 5:

Two longitudinal handles (9) and a handle (11) of an upper lid (10) of an empty container (6) are first hung in parallel filling supports (13) below a filling area (14) for filling the container (6), which can consist of a filling hopper, the container being located as shown in view A of FIG. 5.

The container (6) is gradually opened during the backward movement of the operator who hangs the container.

The container (6) is then filled with a content, normally a bulk material which is unloaded from the filling hopper to the inside of the container (6).

Then, a fork (17) of a forklift truck (18) is placed below the longitudinal handles (9) and the handle (11), carrying out a forward movement and passing the fork (17) through the inside of the longitudinal handles (9) and the handle (11) of the upper lid (10).

The fork (17) is then lifted and the container (6) is removed from the filling area (14), as shown in view B of FIG. 5, moving backwards to remove the container (6) from the filling station.

The fork (17) is then lowered until supporting the container (6) on the ground, removing the fork (17) whereby pulling on the handle (11) and passing the upper lid (10) below the longitudinal handles (9), placing the upper lid (10) in the closed position covering the access to the inside of the container (6), as shown in view C of FIG. 5.

Upon lowering the fork (17) and moving backwards, the handle (11) of the upper lid (10) is pulled on at the same time, detaching the handle (11) with a final downwards movement. The container (6) is thus ready to be then hooked and transported by means of the previously described method.

In view of this description and set of figures, the person skilled in the art will understand that the embodiments of the invention which have been described can be combined in many ways within the object of the invention. The invention has been described according to several preferred embodiments thereof, but for the person skilled in the art it will be evident that multiple variations can be introduced in said preferred embodiments without exceeding the object of the claimed invention.

The invention claimed is:

1. A system comprising a device for handling a container and a container having at least one support handle and a plurality of side panels, wherein the device comprises a single hook for engaging a lifting means, said single hook is configured to hinge around a hinge pin between a folded position in which a space below said hinge pin is free, and a deployed position in which said single hook is below said hinge pin, said device comprises electromagnetic means fixed to the lifting means, said electromagnetic means being configured to generate a magnetic field and to attract at least one ferromagnetic element connected to the at least one support handle of the container, said at least one support handle is not made entirely of ferromagnetic material, said at least one support handle configured to be connected to the container, and said at least one support handle being configured to allow stable lifting at a single point of the container, wherein said single hook consists of a single jaw, wherein said at least one ferromagnetic element is connected to the container at an upper edge of one of the plurality of side panels of the container by a fastening element located at a center position close to the upper edge of said side panel, and the fastening element maintains the ferromagnetic element in a position accessible for the electromagnetic means.

2. The system according to claim 1, wherein actuating the single hook from the deployed position to the folded position is carried out by means of remote control by radio frequency.

3. The system according to claim 1, wherein actuating the single hook from the folded position to the deployed position is carried out manually.

4. The system according to claim 1, wherein actuating the single hook from the folded position to the deployed position is carried out by means of remote control by radio frequency.

5. The system according to claim 1, wherein the electromagnetic means is an electromagnet.

6. The system according to claim 1, wherein the container is in contact with said single hook;

the container further comprising a lower panel.

7. The system according to claim 6, wherein the container comprises four side panels.

8. The system according to claim 6, wherein the side panels and the lower panel are made of woven polyethylene raffia.

9. The system according to claim 6, wherein the container further comprises corner handles at each free upper end of the connection between side panels said corner handles being configured to house said at least one support handle.

10. The system according to claim 1, wherein said at least one support handle is in contact with said single hook.

* * * * *